US005538654A

United States Patent [19]

Lawate et al.

[11] Patent Number: 5,538,654

[45] Date of Patent: Jul. 23, 1996

[54] ENVIRONMENTAL FRIENDLY FOOD GRADE LUBRICANTS FROM EDIBLE TRIGLYCERIDES CONTAINING FDA APPROVED ADDITIVES

[75] Inventors: Saurabh S. Lawate, Concord; Paul C. Naegely, Mentor; Virginia A. Carrick, Chardon, all of Ohio

[73] Assignee: The Lubrizol Corporation, Wickliffe, Ohio

[21] Appl. No.: 348,661

[22] Filed: Dec. 2, 1994

[51] Int. Cl.[6] ..... C10M 141/02

[52] U.S. Cl. ..... 508/308; 508/310; 508/283; 508/286; 508/486; 508/487; 508/437; 508/489

[58] Field of Search ..... 252/565, 56 R, 252/32.7 E, 51.5 A, 50, 47

[56] References Cited

U.S. PATENT DOCUMENTS 3,776,847 12/1973 Pearson et al. .
3,929,656 12/1975 Flis .
3,953,179 4/1976 Soullard et al. .
4,062,785 12/1977 Nibert .
4,073,412 2/1978 Doumani .
4,663,061 5/1987 Kuwamoto et al. .
4,753,742 6/1988 Wilhelm, Jr. .
4,783,274 11/1988 Jokinen et al. .
4,828,727 5/1989 McAninch .
4,957,651 9/1990 Schwind .
5,034,144 7/1991 Ohgake et al. .
5,185,091 2/1993 Ohgake et al. .
5,338,471 8/1994 Lal ..... 252/56 R
5,399,275 3/1995 Lange et al. ..... 252/56 R
5,413,725 5/1995 Lal et al. ..... 252/56 R
5,427,700 6/1995 Stoffa ..... 252/56 R
5,427,704 6/1995 Lawate ..... 252/56 R

*Primary Examiner*—Jacqueline V. Howard
*Attorney, Agent, or Firm*—James L. Cordek; Frederick D. Hunter; Joseph P. Fischer

[57] ABSTRACT

A food grade lubricant composition is described which is useful as hydraulic oil, gear oil, and compressor oil for equipment in the food service industry. This composition comprises (A) major amount of a genetically modified vegetable oil and (B) a minor amount of a performance additive. In other embodiments the composition contains either (C) a phosphorus compound or (D) a non-genetically modified vegetable oil.

29 Claims, No Drawings

ENVIRONMENTAL FRIENDLY FOOD GRADE LUBRICANTS FROM EDIBLE TRIGLYCERIDES CONTAINING FDA APPROVED ADDITIVES

FIELD OF THE INVENTION

The present invention relates to lubricants and more particularly to food grade lubrication oils which are especially useful as hydraulic oils, gear oils, and compressor oils for equipment in the food service industry.

BACKGROUND OF THE INVENTION

The equipment used in the food processing industry varies by segment with the three leading segments comprising meat and poultry, beverages, snack foods, vegetables and dairy. While the equipment varies from segment to segment, the moving parts such as bearing, gears and slide mechanisms are similar and often require lubrication. The lubricants most often used include hydraulic, refrigeration and gear oils as well as all-purpose greases. These food industry oils must meet more stringent standards than other industry lubricants.

Due to the importance of ensuring and maintaining safeguards and standards of quality for food products, the food industry must comply with the rules and regulation set forth by the United States Department of Agriculture (USDA). The Food Safety Inspection Service (FSIS) of the USDA is responsible for all programs for the inspection, grading and standardization of meat, poultry, eggs, dairy products, fruits and vegetables. These programs are mandatory, and this inspection of non-food compounds used in federally inspected plants is required.

The FSIS is custodian of the official list of authorized compounds for use in federally inspected plants. The official list (see page 11-1, List of Proprietary Substances and Non-food Compounds, Miscellaneous Publication Number 1419 (1989) by the Food Safety and Inspection Service, United States Department of Agriculture) states that lubricants and other substances which are susceptible to incidental food contact are considered indirect food additives under USDA regulations. Therefore, these lubricants, classified as either H-1 or H-2, are required to be approved by the USDA before being used in food processing plants. The most stringent classification, H-1 is for lubricants approved for incidental food contact. The H-2 classification is for uses where there is no possibility of food contact and assures that no known poisons or carcinogens are used in the lubricant. The instant invention pertains to an H-1 approved lubricating oil. H-1 approved oil and the terms "food grade" will be used interchangeably for the purpose of this application.

In addition to meeting the requirements for safety set by federal regulatory agencies, the product must be an effective lubricant. Lubricating oils for food processing plants should lubricate machine parts, resist viscosity change, resist oxidation, protect against rusting and corrosion, provide wear protection, prevent foaming and resist the formation of sludge in service. The product should also perform effectively at various lubrications regimes ranging from hydrodynamic thick film regimes to boundary thin film regimes.

The oxidation, thermal and hydrolytic stability characteristics of a lubricating oil helps predict how effectively an oil will maintain its lubricating properties over time and resist sludge formation. Hydrocarbon oils are partially oxidized when contacted with oxygen at elevated temperatures for prolonged periods of time. The oxidation process produces acidic bodies within the lubricating oil which are corrosive to metals often present in food processing equipment, and in contact with both the oil and the air are effective oxidation catalysts which further increases the rate of oxidation. Oxidation products contribute to the formation of sludges which can clog valves, plug filters and result in overall breakdown of the viscosity characteristics of the lubricant. Under some circumstances, sludge formation can result in pluggage, complete loss of oil system flow and failure or damage to machinery.

The thermal and hydrolytic stability characteristics of a lubricating oil reflect primarily on the stability of the lubricating oil additive package. The stability criteria monitor sludge formation, viscosity change, acidity change and the corrosion tendencies of the oil. Hydrolytic stability assesses these characteristics in the presence of water. Inferior stability characteristics result in a lubricating oil that loses lubricating properties over time and precipitates sludge.

It is, therefore desirable to provide an improved food grade lubricating oil which overcomes most, if not all of the proceeding problems.

U.S. Pat. No. 3,776,847 (Pearson et al, Dec. 4, 1973) relates to a lubricating oil composition suitable for the hot rolling of metals, in particular ferrous metals such as steel. The reference further relates to a process for the hot rolling of metals use the lubricating oil compositions as such or as aqueous dispersions and to metal worked by means of the process. The lubricating oil compositions comprise (a) from about 50 to about 85% by weight of a natural fatty oil, (b) from about 0.1 to about 10% by weight of a basic alkaline earth metal salt of an oil soluble petroleum sulfonic acid and (c) from about 5 to about 49.9% by weight of a mineral lubricating oil having a viscosity index of at least 50.

U.S. Pat. No. 3,929,656 (Flis, Dec. 30, 1975) relates to drawing oils that comprise a major portion of a mineral oil of suitable viscosity, from about 5 to 30 weight percent of an additive from the class consisting of vegetable oils and fatty acids and from about 3 to 15 weight percent of a chlorinated paraffin containing greater than 40 percent chlorine.

U.S. Pat. No. 3,953,179 (Souillard et al, Apr. 27, 1976) relates to a lubricating composition for 2 stroke engines which comprises 90 to 97% by weight of a lubricating mixture comprising 15 to 80% by weight of a polymer selected from the group consisting of hydrogenated and non-hydrogenated polybutene, polyisobutylene and mixtures thereof, having a mean molecular weight ranging from 250 to 2000, and 0.5 to 10% by weight of a triglyceride of an unsaturated aliphatic acid containing 18 carbon atoms, the remainder of said mixture being a lubricating oil, and 3 to 10% by weight of lubricating oil additives for 2-stroke engines.

U.S. Pat. No. 4,062,785 (Nibert, Dec. 13, 1977) provides a lubricant composition which is non-toxic and therefore non-contaminating with respect to food and water. The lubricant comprises a major proportion of white oil and a minor proportion of a fatty amide. Neither of these components is toxic so that the lubricant is compatible with the human diet, the fatty amine possesses the necessary quality of lubricity which is imparted in sufficient quantity to the white oil to render the lubricant satisfactory for the lubrication of industrial devices.

The lubricant composition may also desirably contain a fatty triglyceride such as lard oil or olive oil. The triglyceride, while not as effective a lubricity additive as the fatty amine, nevertheless supplies additional lubricity to the combinations of the fatty triglyceride range up to about 10 percent.

U.S. Pat. No. 4,073,412 (Doumani, Feb. 14, 1978) provides a freeze-thaw stable, water-in-oil emulsion composition of lecithin adapted for aerosol delivery onto cookware for cooking surface lubrication, the composition consisting essentially per 100 parts by weight of (a) an organic phase free of liquid alkanes having a specific gravity below 0.75, which phase comprises in proportions to provide to the composition an acid number not higher than 12: from 1 to 10 parts of a lecithin having an acid number between about 24 and 34; from. 0 to about 8 parts of a vegetable oil having an acid number less than about 1; from about 1 to 12 parts of a mineral oil having a specific gravity above 0.80; and an emulsifying-effective amount of an edible fatty acid ester emulsifier having an acid number not higher than 15; and (b) up to 85 parts of an inorganic phase comprising the balance to 100 parts of the composition, which inorganic phase comprises water. The mineral oil specific gravity may range from 0.83 to 0.91 and range from light to heavy to have a viscosity of 50–60 SUS to as high as 450 SUS or more at 100° F.

U.S. Pat. No. 4,663,061 (Kuwamoto et al, May 5, 1987) relates to a metal working oil composition containing (A) one or more lube oil components selected from the group consisting of oils, fats, mineral oils and fatty acid ester, (B) a cationic or amphoteric water-soluble polymer compound having a molecular weight of 1,000 to 10,000,000 and containing nitrogen atoms in the molecule, and (C) a surfactant.

U.S. Pat. No. 4,753,742 (Wilhelm, Jr., Jun. 28, 1988) relates to a lubricant having improved lubricating and protective properties for bread dividers and the like. The lubricants consist essentially of 1% to 99% mineral oil suitable for food processing equipment applications and 1% to 90% lecithin, and have a minimum viscosity of 60 S.U.S. at 100° F. Other embodiment of the lubricant also contain from 1% to 20% nonionic surface active emulsifying agents. Vegetable oils may also be added to comprise from 1% to 80% of the lubricant.

U.S. Pat. No. 4,783,274 (Jokinen et al, Nov. 8, 1988) is concerned with an anhydrous oily lubricant, which is based on vegetable oils, which is substituted for mineral lubricant oils, and which, as its main component, contains triglycerides that are esters of saturated and/or unsaturated straight-chained $C_{10}$ to $C_{22}$ fatty acid and glycerol. The lubricant is characterized in that it contains at least 70 percent by weight of a triglyceride whose iodine number is at least 50 and no more than 125 and whose viscosity index is at least 190. As its basic component, instead of or along with the triglyceride, the lubricant oil may also contain a polymer prepared by hot polymerization out of the triglyceride or out of a corresponding triglyceride. As additives, the lubricant oil may contain solvents, fatty acid derivatives, in particular their metal salts, organic or inorganic, natural or synthetic polymers, and customary additives for lubricants.

U.S. Pat. No. 4,828,727 (McAninch, May 9, 1989) provides a lubricant for use with a conveyor in a meat packing plant meeting the requirements of (1) adequate lubricity, (2) "drip resistance," (3) safety, i.e., approval of the composition and its ingredients by the USDA, (4) rust resistance, (5) economy of manufacture and use and (6) the ability to be removed by cleaning methods is provided by preparing a mixture of mineral oil, a fatty acid and a polybutene, each being acceptable for incidental contact with food, in certain minimum amounts and increasing the amounts of one or more of said components such that the improved lubricant has a viscosity of 20–160 centipoise.

U.S. Pat. No. 4,957,651 (Schwind, Sep. 18, 1990) relates to lubricants comprising a partial fatty acid ester of a polyhydric alcohol and a cosulfurized mixture of 2 or more reactants selected from the group consisting of (1) at least one fatty acid ester of a polyhydric alcohol, (2) at least one fatty acid, (3) at least one olefin and (4) at least one fatty acid ester of a monohydric alcohol to provide a synergistic effect.

U.S. Pat. No. 5,034,144 (Ohgake et al, Jul. 23, 1991) relates to lubricating oil compositions favorably used for food processing machines. The oil compositions exhibit highly improved oxidation stability, wear resistance and rust prevention. Raw materials quite harmless to human bodies can be used in the production of said lubricating oil composition which comprises (I) as the base oil, a saturated fatty acid glyceride represented by the following general formula

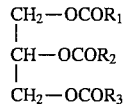

wherein $R_1$, $R_2$ and $R_3$ are each a straight chain alkyl group and (II) as an essential component, a fatty acid in an amount of 0.001 to 5% by weight, based on the total composition.

U.S. Pat. No. 5,185,091 (Ohgake et al, Feb. 9, 1993) relates to a greasy oil and fat composition for food processing machines. The composition is prepared by mixing a fatty acid ester of polyglycerol, oil and fat for food and glycerol, melting the mixture by heating and kneading the mixture.

SUMMARY OF THE INVENTION

A lubricant composition is disclosed which comprises (A) a major amount of at least one genetically modified vegetable oil or synthetic triglyceride oil of the formula

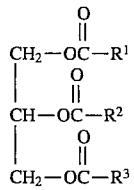

wherein $R^1$, $R^2$ and $R^3$ are aliphatic groups that are at least 60 percent monounsaturated and further wherein an oleic acid moiety:linoleic acid moiety ratio is from 2 up to about 90, and the $R^1$, $R^2$ and $R^3$ groups contain from about 7 to about 23 carbon atoms, and (B) a minor amount of at least one performance additive comprising 1) a phenol comprising (a) an alkyl phenol of the formula

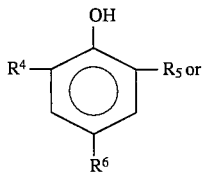

(b) a methylene bridged phenol of the formula

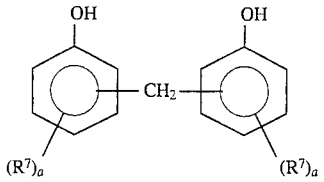

wherein $R^4$ and $R^5$ are aliphatic groups that independently contain from 1 up to about 12 carbon atoms and $R^6$ is hydrogen, an aliphatic or alkoxy group that contains from 1 up to about 12 carbon atoms, $R^7$ is an aliphatic group that contains from 1 up to about 18 carbon atoms and a is an integer of from 0 to 3, or mixtures of the alkyl phenol and methylene bridged phenol;

(2) an N-acyl derivative of sarcosine of the formula

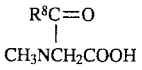

wherein $R^8$ is an aliphatic group that contains from 1 up to about 24 carbon atoms;

(3) a phosphorus amine salt of the formula

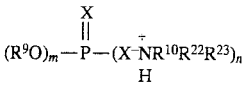

wherein $R^9$ and $R^{10}$ are independently aliphatic groups containing from about up to about 24 carbon atoms, $R^{22}$ and $R^{23}$ are independently hydrogen or aliphatic groups containing from about 1 up to about 18 aliphatic carbon atoms, the sum of m and n is 3 and X is oxygen or sulfur;

(4) a partially esterifed aliphatic ester of glycerol of the formula

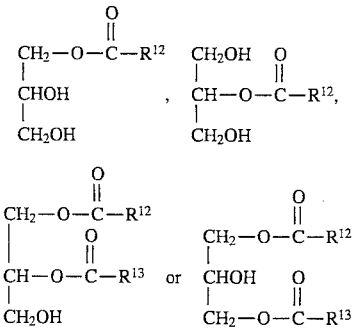

wherein $R^{12}$ and $R^{13}$ are independently aliphatic groups that contains from 7 up to about 23 carbon atoms;

(5) a sorbitan ester

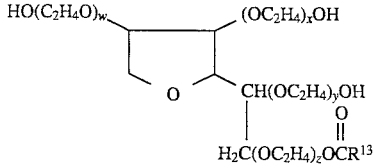

wherein the sum of w, x, y and z is either zero or from 10–60 and $R^{13}$ is an aliphatic group containing from 7 up to about 23 carbon atoms;

(6) an aromatic amine of the formula

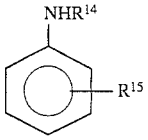

wherein $R^{14}$ is

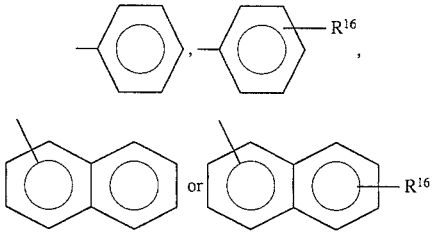

and $R^{15}$ and $R^{16}$ are independently a hydrogen or an alkyl group containing from 1 up to about 24 carbon atoms; or (7) an imidazoline of the formula

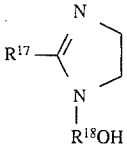

wherein $R^{17}$ is an aliphatic group containing from 1 up to about 24 carbon atoms and $R^{18}$ is an alkylene group containing from 1 up to about 24 carbon atoms.

DETAILED DESCRIPTION OF THE INVENTION

A high performance lubricating oil is provided to lubricate parts such as bearings, gears and slide mechanisms in food processing equipment. The food grade lubricating oil provides outstanding oxidation, thermal and hydrolytic stability; protects against rusting and corrosion; provides wear protection; prevents foaming and resists the formation of sludge.

(A) The Genetically Modified Oil

In practicing this invention a triglyceride oil is employed which is a genetically modified vegetable oil or synthetic triglyceride oil of the formula

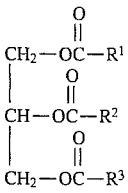

Within the triglyceride formula are aliphatic hydrocarbyl groups $R^1$, $R^2$, and $R^3$ having at least 60 percent monounsaturated character and containing from. about 7 to about 23 carbon atoms. The term "hydrocarbyl group" as used herein denotes a radical having a carbon atom directly attached to the remainder of the molecule. The aliphatic hydrocarbyl groups include the following:

(1) Aliphatic hydrocarbon groups; that is, alkyl groups such as heptyl, nonyl, decyl, undecyl, tridecyl, heptadecyl, octyl; alkenyl groups containing a single double bond such as heptenyl, nonenyl, undecenyl, tridecenyl, heptadecenyl, heneicosenyl; alkenyl groups containing 2 or 3 double bonds such as 8,11-heptadecadienyl and 8,11,14-heptadecatrienyl, and alkynyl groups containing triple bonds. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphafic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen and sulfur.

Vegetable oil triglycerides are naturally occurring. The synthetic triglycerides are those formed by the reaction of one mole of glycerol with three moles of a fatty acid or mixture of fatty acids. Preferred are vegetable oil triglycerides.

Regardless of the source of the triglyceride oil, the fatty acid moieties are such that the triglyceride has a monounsaturated character of at least 60 percent, preferably at least 70 percent and most preferably at least 80 percent. Naturally occurring triglycerides having utility in this invention are exemplified by vegetable oils that are genetically modified such that oil produced by the plants contain a higher than normal oleic acid content. Normal sunflower oil has an oleic acid content of 18–40 percent. By genetically modifying the sunflower plants, a sunflower oil can be obtained wherein the oleic content is from about 60 percent up to about 92 percent. That is, the $R^1$, $R^2$ and $R^3$ groups are heptadecenyl groups and the $R^1COO^-$, $R^2COO^-$, and $R^3COO^-$ that are attached to the 1,2,3-propanetriyl group—$CH_2CHCH_2$— are the residue of an oleic acid molecule. U.S. Pat. Nos. 4,627,192 and 4,743,402 are herein incorporated by reference for their disclosure to the preparation of high oleic sunflower oil.

For example, a triglyceride comprised exclusively of an oleic acid moiety has an oleic acid content of 100% and consequently a monounsaturated content of 100%. Where the triglyceride is made up of acid moieties that are 70% oleic acid, 10% stearic acid, 13% palmitic acid, and 7% linoleic, the monounsaturated content is 70%. The preferred triglyceride oils are high oleic (at least 60 percent) acid triglyceride oils. Typical high oleic vegetable oils employed within the instant invention are high oleic safflower oil, high oleic peanut oil, high oleic corn oil, high oleic rapeseed oil, high oleic sunflower oil, high oleic soybean oil, high oleic cottonseed oil, high oleic lesquerella oil and high oleic palm olein. A preferred high oleic vegetable oil is high oleic sunflower oil obtained from *Helianthus sp.* This product is available from SVO Enterprises Eastlake, Ohio as Sunyl® high oleic sunflower oil. Sunyl 80 oil is a high oleic triglyceride wherein the acid moieties comprise about 80 percent oleic acid and Sunyl 90 oil is a high oleic triglyceride wherein the acid moieties comprise about 90 percent oleic acid. Another preferred high oleic vegetable oil is high oleic rapeseed oil obtained from *Brassica campestris* or *Brassica napus,* also available from SVO Enterprises. RS80 oil signifies a rapeseed oil wherein the acid moieties comprise about 80 percent oleic acid.

It is to be noted the olive oil is excluded as a genetically modified vegetable oil (A) in this invention. The oleic acid content of olive oil typically ranges from 65–85 percent. This content, however, is not achieved through genetic modification., but rather is naturally occurring.

It is further to be noted that genetically modified vegetable oils have high oleic acid contents at the expense of the di-and tri- unsaturated acids. A normal sunflower oil has from 20–40 percent oleic acid moieties and from 50–70 percent linoleic acid moieties. This gives a 90 percent content of monoand di- unsaturated acid moieties (20+70) or (40+50). Genetically modifying vegetable oils generate a low di- or tri- unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for nonhal sunflower oil is about 0.5 (30 percent oleic acid moiety and 60 percent linoleic acid moiety).

(B) The Performance Additive

The compositions of this invention also include (B) a performance additive. The performance enhanced by these additives are in the area of antiwear, oxidation inhibition, rust/corrosion inhibition, metal passivation, extreme pressure, friction modification, foam inhibition, emulsification, lubricity, and the like The performance additive (B) comprises at least one (1) phenol, (2) acyl derivative of sarcosine, (3) phosphorus amine salt (4) partially esterified aliphatic ester of glycerol, (5) sorbitan ester, (6) aromatic amine, or (7) imidazoline (B) (1) The Phenol The phenol utilized as component (B)(1) is (a) an alkyl phenol of the formula

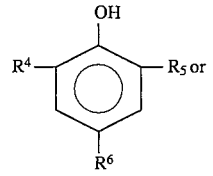

(b) a methylene bridged phenol of the formula

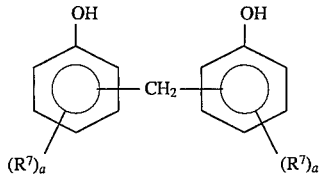

wherein $R^4$ and $R^5$ are aliphatic groups that independently contain from 1 up to about 12 carbon atoms and $R^6$ is hydrogen, an aliphatic or alkoxy group that contains from 1 up to about 12 carbon atoms, $R^7$ is an aliphatic group that contains from 1 up to about 18 carbon atoms and a is an integer of from 0 to 3. Component (B)(1) can also be mixtures of the alkyl phenol and methylene bridged phenol.

Regarding the alkyl phenol (B)(1)(a), $R^4$ and $R^5$ are t-butyl groups. When $R^6$ is not hydrogen it preferably contains from 1 to 8 carbon atoms and most preferably from 1 to 4 carbon atoms either as an aliphatic group or as an alkoxy group.

Regarding the methylene bridged phenol (B)(1)Co), $R^7$ preferably contains from 6–18 carbon atoms and most preferably from 10–12 carbon atoms; most preferably a is 1.

(B)(2) The N-Acyl Derivative of Sarcosine

Sarcosine or N-methylglycine has the formula $CH_3$ NH $CH_2COOH$

N-acyl derivatives of sarcosine have the formula

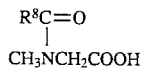

wherein $R^8$ is an aliphatic group containing from 1 up to about 24 carbon atoms. Preferably $R^8$ contains from 6 to 24 carbon atoms and most preferably from 12 to 18 carbon atoms. A most preferred N-acyl derivative of sarcosine is N-methyl-N-(1-oxo-9-octadecenyl) glycine wherein $R^8$ is a heptadecenyl group. This derivative is available from Ciba-Geigy under the name Sarkosyl® O.

(B)(3) The Phosphorus Amine Salt

Another performance additive is a phosphorus amine salt of the formula

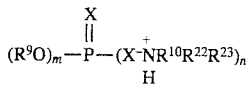

wherein $R^9$ and $R^{10}$ are independently aliphatic groups containing from about up to about 24 carbon atoms, $R^{22}$ and $R^{23}$ are independently hydrogen or aliphatic groups containing from about 1 up to about 18 aliphatic carbon atoms, the sum of m and n is 3 and X is oxygen or sulfur. In a preferred embodiment, $R^9$ contains from about 8 up to 18 carbon atoms, $R^{10}$ is

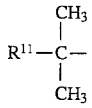

wherein $R^{11}$ is an aliphatic group containing from about 6 up to about 12 carbon atoms, $R^{22}$ and $R^{23}$ are hydrogen, m is 2, n is 1 and X is oxygen. In a most preferred embodiment, component (C) is Irgalube® 349 which is commercially available from Ciba-Geigy.

(B)(4) The Partially Esterified Aliphatic Ester of Glycerol

The partially esterified aliphatic ester of glycerol has the formula

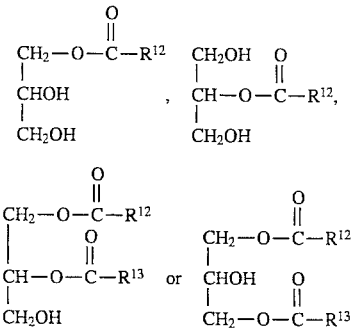

wherein $R^{12}$ and $R^{13}$ are independently aliphatic groups that contains from 7 up to about 23 carbon atoms. Aliphatic esters of glycerol are prepared by reacting 1 or 2 moles of a carboxylic acid $R^{12}$ COOH with 3 moles of glycerol to form respectively a glycerol mono-ester or glycerol di-ester or by selective hydrolysis of a triglyceride. The groups $R^{12}$ and $R^{13}$ preferably contains from 8 to 23 carbon atoms and most preferably from 12 to 18 carbon atoms. In a most preferred embodiment, $R^{12}$ is a mixture of alkyl and alkenyl groups wherein the alkenyl groups are at least 60 percent with the remainder being alkyl and alkenyl groups. Most preferably this $R^{12}$ mixture contains at least 75% alkenyl groups. Preferably the alkenyl group is a heptadecenyl group.

(B)(5) The Sorbitan Ester

The sorbitan ester is of the structure

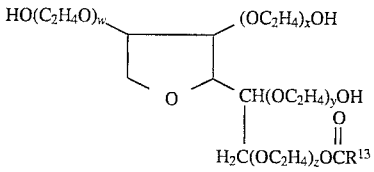

wherein the sum of w, x, y and z is either zero or from 10–60 and $R^{13}$ is a heptadecenyl group. This structure is commercially available as Span 80. In another embodiment, the sum of w, x, y and z is 20 and $R^{13}$ is a heptadecenyl group. This structure is commercially available as Tween 80.

(B)(6) The Aromatic Amine

Component (B)(6) is an aromatic amine of the formula

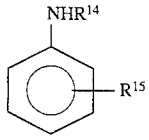

wherein $R^{14}$ is

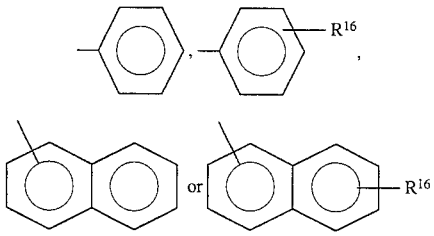

and $R^{15}$ and $R^{16}$ are independently a hydrogen or an alkyl group containing from 1 up to 24 carbon atoms. Preferably $R^{14}$ is

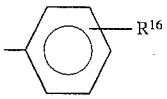

and $R^{15}$ and $R^{16}$ are alkyl groups containing from 4 up to about 18 carbon atoms. In a particularly advantageous embodiment, component (B)(6) comprises alkylated diphenylamine such as nonylated diphenylamine of the formula

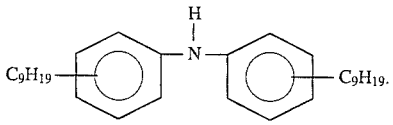

(B)(7) The Imidazoline

The imidazoline of this invention is of the formula

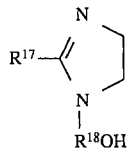

wherein $R^{17}$ is an aliphatic group containing from 1 up to about 24 carbon atoms and $R^{18}$ is an alkylene group containing from 1 up to about 24 carbon atoms. Preferably $R^{17}$ is an alkenyl group containing from 12 to 18 carbon atoms. Preferably $R^{18}$ contains from 1 to 4 carbon atoms and most preferably $R^{18}$ is an ethylene group. A most preferred imidazoline has the formula

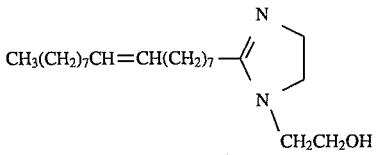

and is commercially available from Ciba-Geigy under the name Amine O.

(C) The Phosphorus Compound

Components (A) and (B) may further comprise component (C) a phosphorus compound. The phosphorus compound is the formula

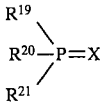

wherein $R^{19}$, $R^{20}$ and $R^{21}$ are independently hydrogen, an aliphatic or alkoxy group containing from 1 up to about 12 carbon atoms, or an aryl or aryloxy group wherein the aryl group is phenyl or naphthyl and the aryloxy group is phenoxy or naphthoxy and X is oxygen or sulfur. A most preferred phosphorus compound is triphenyl phosphothionate, also know as TPPT. This most preferred phosphorus compound is available from Ciba-Geigy under the name Irgalube® TPPT. The structure of TPPT is

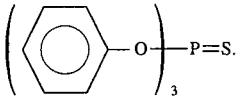

(D) The Non-Genetically Modified Vegetable Oil

Components (A) and (B) may further comprise component (D) a non-genetically modified vegetable oil. Vegetable oils having utility are rapeseed oil, meadowfoam oil, peanut oil, palm oil, corn oil, castor oil, soybean oil, 1 esquerella oil, sunflower oil, cottonseed oil, olive oil and coconut oil. The preferred oils are castor oil and rapeseed oil. It is noted that there are two types of rapeseed oil. Low erucic rapeseed oil, also known as canola oil, which contains 50–66% oleic acid moiety and 0–5% erucic acid moiety and high erucic rapeseed oil which contains 9–25% oleic acid moiety and 30–60% erucic acid moiety.

The compositions of the present invention comprising components (A) and (B), (A) (B) and (C) or (A), (B) and (D) are useful as food grade lubrication oils having H-1 approval as required by the USDA.

As a formulated lubricating composition within the present invention, when the composition comprises components (A) and (B), the (A) : (B) weight ratio is generally from (95–99.9): (0.1–5), preferably from (97.5–99.9): (0.1–2.5) and most preferably from (99–99.9): (0.1–1)

As a formulated lubricating composition within the present invention, when the composition comprises components (A), (B) and (C), the following states the weight ratio ranges of these components.

| COMPONENT | GENERALLY | PREFERRED | MOST PREFERRED |
|---|---|---|---|
| (A) | 94–99.9 | 96.25–99.9 | 98.5–99.9 |
| (B) | 0.05–5 | 0.05–3 | 0.05–1 |
| (C) | 0.05–1 | 0.05–0.75 | 0.05–0.5 |

As a formulated lubricating composition within the present invention, when the composition comprises components (A), (B) and (D), the following states the weight ratio ranges of these components.

| COMPONENT | GENERALLY | PREFERRED | MOST PREFERRED |
|---|---|---|---|
| (A) | 50–98.95 | 77–94.95 | 79–89.95 |
| (B) | 0.05–5 | 0.05–3 | 0.05–1 |
| (D) | 1–45 | 5–20 | 10–20 |

It is also to be recognized that concentrates of the invention can be formed. The concentrates comprise a minor amount of (A) with a major amount of (B), a minor amount of (A) with a major amount of the combination of (B) and (C) or a minor amount of the combination of (A) and (D) with a major amount of (B).

The term "minor amount" as used in the specification and appended claims is intended to mean that when a composition contains a "minor amount" of a specific material that amount is less than 50 percent by weight of the composition.

The term "major amount" as used in the specification and appended claims is intended to mean that when a composition contains a "major amount" of a specific material that amount is more than 50 percent by weight of the composition.

It is understood that the other components besides (A), (B), (C) and (D) may be present within the composition of this invention. An especially preferred component includes an anti foaming agent. Since the lubricant composition of this invention is generally subjected to substantial mechanical agitation and pressure, the inclusion of an antifoaming agent is highly desirable in order to reduce and/or eliminate foaming. This foaming could cream problems with the mechanical operations of the device with which the lubricant composition is used. The antifoaming agent is generally present in an amount of from about 0.001 to about 0.2 parts by weight based on the weight of the lubricant composition. Useful antifoaming agents are a commercial dialkyl siloxane polymer or a polymer of an alkyl methacrylate.

The components of this invention are blended together according to the above ranges to effect solution. The following tables outline examples so as to provide those of ordinary skill in the art with a complete disclosure and description on how to make the composition of this invention and is not intended to limit the scope of what the inventors regard as their invention. All parts are by weight.

Table I is a comparison of the rotary bomb oxidation test (RBOT) of component (A) only (baseline), versus component (A) containing a performance additive, component (B). An improvement is noted in the RBOT on all examples that contain component (B)

TABLE I

| EXAMPLE | (A) | (B) | RBOT |
|---|---|---|---|
| 1 | 100 parts Sunyl 80 oil | None | 14 |
| 2 | 99 parts Sunyl 80 oil | 1 part butyrated hydroxytoluene | 76 |
| 3 | 98 parts Sunyl 80 oil | 2 parts butyrated hydroxytoluene | 105 |
| 4 | 97 parts Sunyl 80 oil | 3 parts butyrated hydroxytoluene | 89 |
| 5 | 95 parts Sunyl 80 oil | 5 parts butyrated hydroxytoluene | 67 |
| 6 | 98.5 parts Sunyl 80 oil | 1 part butyrated hydroxytoluene<br>0.5 parts oleyl sarcosine | 34 |
| 7 | 98.5 parts Sunyl 90 oil | 1 part butyrated hydroxytoluene<br>0.5 parts oleyl sarcosine | 57 |
| 8 | 99 parts Sunyl 90 oil | 1 part butyrated hydroxytoluene | 118 |

In Table II a comparison is shown between component (A) alone versus a blend of component (A) and component (B)(3) in the Shell 4-Ball Wear Test.

TABLE II

| EXAMPLE | (A) | (B) | 4 BALL WEAR Avg. Scar Diam/Avg. Coeff of Friction |
|---|---|---|---|
| 1 | 100 parts Sunyl 80 oil | None | 0.64/0.082 |
| 2 | 99.75 parts Sunyl 80 oil | 0.5 parts Irgalube 349 | 0.38/0.069 |
| 3 | 99.5 parts Sunyl 80 oil | 0.25 parts Irgalube 349 | 0.37/0.069 |

Table III relates to comparisons between component (A) alone verses a blend of component (A) with component (B) compounds. The Table III evaluations are directed to RBOT, rust and Shell 4-Ball Wear Test.

TABLE III

| EXAMPLE | (A) | (B) | RBOT | RUST | 4 BALL WEAR Avg Diam/Avg Coeff |
|---|---|---|---|---|---|
| 1 | 100 parts Sunyl 80 oil | None | 14 | Severe fail | 0.64/0.082 |
| 2 | 97.5 parts Sunyl 80 oil | 1.0 part butyrated hydroxytoluene<br>0.5 parts oleyl sarcosine<br>0.5 parts glycerol monooleate<br>0.5 parts Irgalube 349 | 43 | clean pass | 0.39/0.069 |
| 3 | 97.5 parts Sunyl 80 oil | 1.0 part butylated hydroxytoluene<br>0.5 parts oleyl sarcosine<br>0.5 parts glycerol monooleate<br>0.5 parts Irgalube 349 | 41 | clean pass | 0.48/0.068 |

Several commercial formulations are evaluated against a combination of component (A) and component (B) blend of the instant invention in a Vickers 104C Pump Test. This test measures the total cam and ring weight loss in milligrams. This test is a standardized ASTM procedure (ASTM D-82) used widely by the petroleum industry in measuring wear characteristics of hydraulic fluids.

TABLE IV

| EXAMPLE | FORMULATION | VICKERS 104 C PUMP TEST WEIGHT LOSS (mg) |
|---|---|---|
| 1 | Example 3 of Table III | 6 |
| 2 | Amoco FG Oil 68-EL | 14 |
| 3 | Mobil EAL224 | 18 |

A combination of component (A) and component (B) blend of the instant invention is compared to a combination of a food grade mineral oil and component (B) blend in order to obtain a direct comparison of the triglyceride oil, component (A), to a food grade mineral oil. These two blends are evaluated in the Cincinnati Milacron Test. This test measures the amount of sludge formed in milligrams per 100 milliliters and also the percent evaporation.

TABLE V

| EX-AMPLE | FORMULATION | SLUDGE mg/100 ml | % EVAPOR-ATION |
|---|---|---|---|
| 1 | Example 3 of Table III | 0.4 | 0.8 |
| 2 | Example 3 of Table III replacing Sunyl 80 oil with an equal weight of Amoco Packers Technical Mineral Oil | 164.2 | 11.7 |

Table VI compares RBOT values of component (A) by itself, a blend of components (A) and (C) and a blend of components (A), (B) and (C). Merely blending component (C) into (A) does not provide for an improvement in the RBOT value.

TABLE VI

| EXAMPLE | (A) | (B) | (C) | RBOT |
|---|---|---|---|---|
| 1 | 100 parts Sunyl 80 oil | None | None | 14 |
| 2 | 99.5 parts Sunyl 80 oil | None | 0.5 parts TPPT | 13 |
| 3 | 98 parts Sunyl 80 oil | 1 part butylated hydroxyloluene<br>0.5 parts oleyl sarcosine | 0.5 parts TPPT | 35 |
| 4 | 97.5 parts Sunyl 80 oil | 1 part butylated hydroxytoluene<br>1 part glycerol monooleate | 0.5 parts TPPT | 85 |
| 5 | 97 parts Sunyl 80 oil | 1 part butylated hydroxytoluene<br>0.5 parts oleyl sarcosine<br>1 part glycerol monooleate | 0.5 parts TPPT | 47 |

Table VII compares RBOT values of component (A) by itself, a blend of components (A) and (D) and a blend of components (A), (B) and (D). It was not expected that the blending of two different triglycerides oils, component (A) and (D), would provide for an improvement in the RBOT value.

TABLE VII

| EXAMPLE | (A) | (B) | (D) | RBOT |
|---|---|---|---|---|
| 1 | 100 parts Sunyl 80 oil | None | None | 14 |
| 2 | 90 parts Sunyl 80 oil | None | 10 parts castor oil | 14 |
| 3 | 89.1 parts Sunyl 80 oil | 1 part butyrated hydroxytoluene | 9.9 parts castor oil | 65 |
| | 87.75 parts Sunyl 80 oil | 1 part butyrated hydroxytoluene<br>0.5 parts oleyl sarcosine<br>0.5 parts Irgalube 349<br>0.5 parts glycerol monooleate | 9.75 parts castor oil | 38 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is a claimed is:

1. A lubricant composition, comprising;

(A) a major amount of at least one genetically modified vegetable oil or synthetic triglyceride oil of the formula

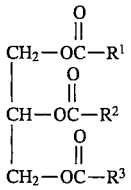

wherein $R^1$, $R^2$ and $R^3$ are aliphatic groups that are at least 60 percent monounsaturated and further wherein an oleic acid moiety:linoleic acid moiety ratio is from 2 up to about 90, and the $R^1$, $R^2$ and $R^3$ groups contain from about 7 to about 23 carbon atoms, and (B) a minor amount of at least one performance additive comprising (1) a phenol comprising (a) an alkyl phenol of the formula

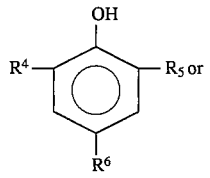

(b) a methylene bridged phenol of the formula

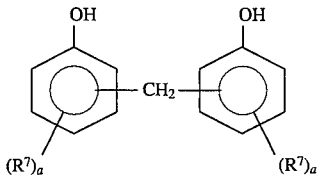

wherein $R^4$ and $R^5$ are aliphatic groups that independently contain from 1 up to about 12 carbon atoms and $R^6$ is hydrogen, an aliphatic or alkoxy group that contains from 1 up to about 12 carbon atoms, $R^7$ is an aliphatic group that contains from 1 up to about 18 carbon atoms and a is an integer of from 0 to 3, or mixtures of the alkyl phenol and methylene bridged phenol;

(2) an N-acyl derivative of sarcosine of the formula

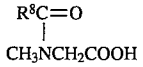

wherein $R^8$ is an aliphatic group that contains from 1 up to about 24 carbon atoms;

(3) a phosphorus amine salt of the formula

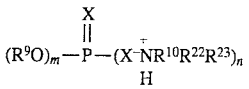

wherein $R^9$ and $R^{10}$ are independently aliphatic groups containing from about 4 up to about 24 carbon atoms, $R^{22}$ and $R^{23}$ are independently hydrogen or aliphatic groups containing from about 1 up to about 18 aliphatic carbon atoms, the sum of m and n is 3 and X is oxygen or sulfur.

(4) a partially esterified aliphatic ester of glycerol of the formula

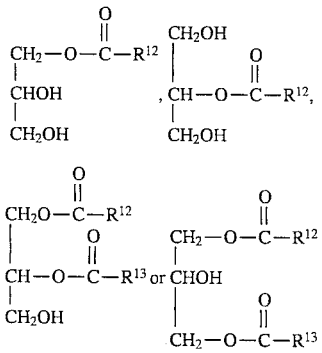

wherein $R^{12}$ and $R^{13}$ are aliphatic groups that contains from 7 up to about 23 carbon atoms;

(5) a sorbitan ester

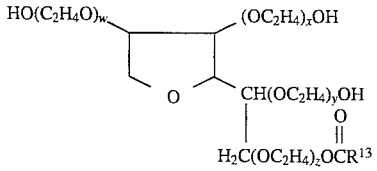

wherein the sum of w, x, y and z is either zero or from 10–60 and $R^{13}$ is an aliphatic group containing from 7 up to about 23 carbon atoms;

(6) an aromatic amine of the formula

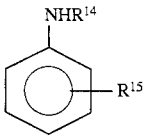

wherein $R^{14}$ is

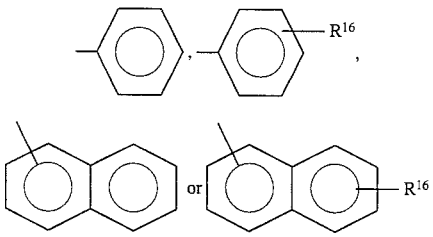

and $R^{15}$ and $R^{16}$ are independently a hydrogen or an alkyl group containing from 1 up to about 24 carbon atoms; or (7) an imidazoline of the formula

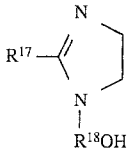

wherein $R^{17}$ is an aliphatic group containing from 1 up to about 24 carbon atoms and $R^{18}$ is an alkylene group containing from 1 up to about 24 carbon atoms.

2. The composition of claim 1 wherein the triglyceride is a genetically modified vegetable oil triglyceride comprising high oleic safflower oil, high oleic corn oil, high oleic rapeseed oil, high oleic sunflower oil., high oleic soybean oil, high oleic cottonseed oil, high oleic lesquerella oil, and high oleic palm olein.

3. The composition of claim 1 wherein the synthetic triglyceride oil is an ester of at least one straight chain fatty acid and glycerol wherein the fatty acid contains from about 8 to about 22 carbon atoms.

4. The composition of claim 2 wherein the triglyceride is at least 70 percent monounsaturated.

5. The composition of claim 2 wherein the triglyceride is at least 80 percent monounsaturated.

6. The composition of claim 1 wherein the monounsaturated fatty acid is oleic acid.

7. The composition of claim 1 wherein within (B)(1) $R^4$ and $R^5$ are t-butyl groups and $R^6$ is a methyl group.

8. The composition of claim 1 wherein within (B)(1) $R^4$ and $R^5$ are t-butyl groups and $R^6$ is hydrogen.

9. The composition of claim 1 wherein within (B)(2) $R^8$ contains from about 8 up to about 24 carbon atoms.

10. The composition of claim 9 wherein within (B)(2) $R^8$ is an heptadecenyl group.

11. The composition of claim 1 wherein within (B) (3) $R^9$ contains from about 4 up to 18 carbon atoms, $R^{22}$ and $R^{23}$ are hydrogen, $R^{10}$ is

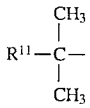

wherein $R^{11}$ is an aliphatic group containing from about 6 up to about 12 carbon atoms, m is 2, n is 1 and X is oxygen.

12. The composition of claim 1 wherein within (B)(4) $R^{12}$ contains from about 8 up to about 24 carbon atoms.

13. The composition of claim 12 wherein within (B)(4)$R^{12}$ is a heptadecenyl group.

14. The composition of claim 1 wherein within (B)(5) $R^{13}$ is an alkenyl group and contains from about 11 up to about 23 carbon atoms.

15. The composition of claim 14 wherein within (B)(5) $R^{13}$ is a heptadecenyl group.

16. The composition of claim 15 wherein within (B)(5) the sum of w, x, y and z is zero.

17. The composition of claim 15 wherein within (B)(5) the sum of w, x, y and z is 20.

18. The composition of claim 1 wherein within (B)(6) $R^{14}$ is

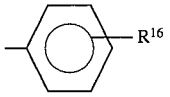

and $R^{15}$ and $R^{16}$ are nonyl groups.

19. The composition of claim 1 further comprising (C) a phosphorus compound of the formula

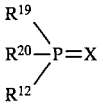

wherein $R^{19}$, $R^{20}$ and $R^{21}$ are independently hydrogen, an aliphatic or alkoxy group containing from 1 up to about 12 carbon atoms, or an aryl or aryloxy group wherein the aryl group is phenyl or naphthyl and the aryloxy group is phenoxy or naphthoxy and X is oxygen or sulfur.

20. The composition of claim 19 wherein within (C) $R^{19}$, $R^{20}$ and $R^{21}$ are phenoxy groups and X is sulfur.

21. The composition of claim 1 further comprising (D) a nongenetically modified vegetable oil comprising rapeseed oil, meadowfoam oil, peanut oil, palm oil, corn oil, castor oil, soybean oil, lesquerella oil, sunflower oil, cottonseed oil, olive oil, or coconut oil.

22. The composition of claim 21 wherein the vegetable oil is rapeseed oil.

23. The composition of claim 21 wherein the vegetable oil is castor oil.

24. The formulated lubricant composition of claim 1 wherein the weight ratio of (A):(B) is (95–99.9):(0.1–5).

25. The formulated lubricant composition of claim 19 wherein the weight ratio of (A):(B):(C) is (94–99.9):(0.05–5):(0.05–1).

26. The formulated lubricant composition of claim 21 wherein the weight ratio of (A):(B):(D) is (50–98.95):(0.05–5):(1–45).

27. A concentrate according to claim 1 which comprises a minor amount of (A) and a major amount of (B).

28. A concentrate according to claim 19 which comprises a minor amount of (A) and a major amount of the combination of (B) and (C).

29. A concentrate according to claim 21 which comprises a minor amount of the combination of (A) and (D) and a major amount of (B).

* * * * *